US010312046B1

(12) United States Patent
Clark et al.

(10) Patent No.: US 10,312,046 B1
(45) **Date of Patent: *Jun. 4, 2019**

(54) ROTARY MOTION SWITCHING APPARATUS USABLE WITH CIRCUIT INTERRUPTER

(71) Applicant: EATON INTELLIGENT POWER LIMITED, Dublin (IE)

(72) Inventors: John Thomas Clark, Beaver, PA (US); Ramesh Shivaji Powar, Kolhapur (IN); Sujit Subhash Patwardhan, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/154,845

(22) Filed: Oct. 9, 2018

Related U.S. Application Data

(63) Continuation-in-part of application No. 15/972,414, filed on May 7, 2018, and a continuation-in-part of application No. 15/875,177, filed on Jan. 19, 2018.

(51) Int. Cl.

| | |
|---|---|
| ***H01H 19/04*** | (2006.01) |
| ***H01H 71/56*** | (2006.01) |
| ***H01H 9/28*** | (2006.01) |
| ***H01H 9/22*** | (2006.01) |
| ***H01H 3/10*** | (2006.01) |

(52) U.S. Cl.
CPC ..... *H01H 71/56* (2013.01); *H01H 3/10* (2013.01); *H01H 9/22* (2013.01); *H01H 9/282* (2013.01); *H01H 2071/565* (2013.01)

(58) Field of Classification Search
CPC ..... H01H 19/04; H01H 19/08; H01H 19/14; H01H 3/08; H01H 71/56; H01H 71/46; H01H 2071/565
USPC ..... 200/293, 329–331, 336
See application file for complete search history.

(56) References Cited

U.S. PATENT DOCUMENTS

| | | | | |
|---|---|---|---|---|
| 3,260,808 | A | 7/1966 | Dimond et al. | |
| 3,324,259 | A | 6/1967 | Chamberlin, Jr. et al. | |
| 5,288,958 | A * | 2/1994 | Grunert | H01H 9/22 200/329 |
| 5,493,084 | A * | 2/1996 | Whitaker | H01H 3/10 200/330 |
| 6,423,912 | B1 * | 7/2002 | Arenz | H01H 9/282 200/336 |
| 6,518,526 | B2 | 2/2003 | Hamada et al. | |
| 6,566,618 | B2 * | 5/2003 | Hamada | H01H 71/56 200/308 |
| 6,969,813 | B1 | 11/2005 | Winslett et al. | |
| 7,002,088 | B2 * | 2/2006 | Shin | H01H 71/56 200/330 |

(Continued)

*Primary Examiner* — Edwin A. Leon
(74) *Attorney, Agent, or Firm* — Eckert Seamans

(57) ABSTRACT

A rotary motion switching apparatus is usable with a circuit interrupter that is situated in a NEMA box or other box and employs an attachment system. An access port that is formed in a wall of the NEMA box or other box permits a shaft having a handle at an end thereof to be connected with the rotary motion switching apparatus. The rotary motion switching apparatus includes a universal joint on a rotational component that enables operation of the handle and shaft without binding on the wall of the NEMA or other box even if the access port in the box is offset from an axis of rotation of the rotational component.

20 Claims, 14 Drawing Sheets

(56) References Cited

U.S. PATENT DOCUMENTS 7,399,934 B2 * 7/2008 Emura ..... H01H 9/22
200/43.11

* cited by examiner

ROTARY MOTION SWITCHING APPARATUS USABLE WITH CIRCUIT INTERRUPTER

CROSS-REFERENCE TO RELATED APPLICATION

The instant patent application claims priority from U.S. patent application Ser. No. 15/875,177 filed Jan. 19, 2018, and from U.S. patent application Ser. No. 15/972,414 filed May 7, 2018, the disclosures of which are incorporated herein by reference.

BACKGROUND

Field

The disclosed and claimed concept relates generally to electrical switching equipment and, more particularly, to a rotary motion switching apparatus that is usable with a circuit interrupter.

Related Art

Numerous types of switching equipment is known in the relevant art. Among such switching equipment are any of a wide variety of circuit interrupters that are known to interrupt electrical power to a protected portion of a circuit in certain overcurrent and under-voltage conditions, as well as in numerous other predefined conditions. While such circuit interruption devices have been generally effective for their intended purposes, they have not been without limitation.

In certain applications, it is necessary for a circuit interrupter to be situated within an interior region of a National Electrical Manufacturers Association (NEMA) box for any of a wide variety of reasons. As is known in the relevant art, circuit interrupters typically have a handle that is movable among ON, OFF, and TRIPPED positions, and it is thus also known that the switching of the circuit interrupter between those positions can be made more difficult if the circuit interrupter is situated within the interior of a NEMA box. While some solutions have been known to exist in which a control mechanism extends between a circuit interrupter situated within the interior of a NEMA box and a handle or other implement situated at the exterior of the NEMA box, such solutions have typically involved a number of modifications to the to the housing of the circuit interrupter or to the molding that is used to mold the housing of the circuit interrupters, thus resulting in undesirable expense.

As employed herein, the expression "a number of" and variations thereof shall refer broadly to any non-zero quantity, including a quantity of one. Improvements thus would be desirable.

SUMMARY

An improved rotary motion switching apparatus is usable with a circuit interrupter that is situated in a NEMA box or other box and employs an attachment system. An access port that is formed in a wall of the NEMA box or other box permits a shaft having a handle at an end thereof to be connected with the rotary motion switching apparatus. The handle is situated at the exterior of the NEMA box or other box, and the rotary motion switching apparatus is situated internal to the box. In one embodiment the attachment system has a pair of connectors that are received in a pair of openings that are already formed in a housing of a circuit interrupter and that are affixed to the housing within the openings in order to resist removal of the rotary motion switching apparatus from the circuit interrupter. The openings are pre-existing in the housing of the circuit interrupter and are provided to enable access by tools such as screwdrivers and the like with terminals of the circuit interrupter to which load wires and the like are connectable. The connectors thus secure the rotary motion switching apparatus to the circuit interrupter by using openings that are already formed in the circuit interrupter and thus the rotary motion switching apparatus is usable without requiring a modification to the housing or to the molds that are employed to form the housing. In another embodiment the attachment system has three connectors that are engaged with an exterior surface of the housing of the circuit interrupter in order to resist removal of the rotary motion switching apparatus from the circuit interrupter. The portions of the housing that are engaged by the three connectors are pre-existing portions of the exterior surface of the housing of the circuit interrupter. In still another embodiment, a rotary motion switching apparatus includes a universal joint on a rotational component that enables operation of the handle and shaft without binding on the wall of the NEMA or other box even if the access port in the box is offset from an axis of rotation of the rotational component.

Accordingly, an aspect of the disclosed and claimed concept is to provide an improved rotary motion switching apparatus that is usable in conjunction with a circuit interrupter and a NEMA box but that does not require modification of the housing of the circuit interrupter and that likewise does not require any modification of the mold that is employed to form the housing.

As such, an aspect of the disclosed and claimed concept is to provide an improved rotary motion switching apparatus that is usable with a circuit interrupter, the circuit interrupter having a housing, a switch situated on the housing, and at least a first opening formed in the housing. The rotary motion switching apparatus can be generally stated as including a base, an attachment system situated on the base, the attachment system can be generally stated as including at least a first connector that is elongated, the at least first connector being structured to be at least partially received in the at least a first opening and being further structured to engage the housing within the at least first opening to resist removal of the at least first connector from the at least first opening and to affix the base to the housing, a crank apparatus situated on the base, the crank apparatus can be generally stated as including a first portion and a second portion, the first portion being pivotable about an axis of rotation between a first orientation and a second orientation, the first portion and the second portion being engaged with one another at a location spaced from the axis of rotation, at least a part of the second portion being translatable along a movement axis between a first position and a second position, the first portion being in the first orientation when the at least part of the second portion is in the first position, the first portion being in the second orientation when the at least part of the second portion is in the second position, and the second portion having a number of lugs that are structured to engage the switch and to move the switch between a first state and a second state, the at least part of the second portion being structured to be in the first position when the switch is in the first state, the at least part of the second portion being structured to be in the second position when the switch is in the second state.

Another aspect of the disclosed and claimed concept is to provide an improved rotary motion switching apparatus that is usable with a number of circuit interrupters, each circuit interrupter of the number of circuit interrupters having a housing and further having a switch situated on the housing. The rotary motion switching apparatus can be generally stated as including a base, an attachment system situated on the base, the attachment system can be generally stated as including a first connector, a second connector, and a third connector that are structured to engage a housing of a circuit interrupter of the number of circuit interrupters to retain the housing between the first, second, and third connectors and to affix the base to the housing, a crank apparatus situated on the base, the crank apparatus can be generally stated as including a first portion and a second portion, the first portion being pivotable about an axis of rotation between a first orientation and a second orientation, the first portion and the second portion being engaged with one another at a location spaced from the axis of rotation, at least a part of the second portion being translatable along a movement axis between a first position and a second position, the first portion being in the first orientation when the at least part of the second portion is in the first position, the first portion being in the second orientation when the at least part of the second portion is in the second position, and the second portion having a number of lugs that are structured to engage a switch of a circuit interrupter of the number of circuit interrupters and to move the switch between a first state and a second state, the at least part of the second portion being structured to be in the first position when the switch is in the first state, the at least part of the second portion being structured to be in the second position when the switch is in the second state.

Still another aspect of the disclosed and claimed concept is to provide an improved rotary motion switching apparatus that is usable with a number of circuit interrupters, each circuit interrupter of the number of circuit interrupters having a housing and further having a switch situated on the housing. The rotary motion switching apparatus can be generally stated as including a base, an attachment system situated on the base, the attachment system can be generally stated as including a number of connectors that are structured to engage a housing of a circuit interrupter of the number of circuit interrupters to affix the base to the housing, a crank apparatus situated on the base, the crank apparatus can be generally stated as including a first portion, a second portion, and a third portion, the first portion being pivotable about an axis of rotation between a first orientation and a second orientation, the first portion and the second portion being engaged with one another at a location spaced from the axis of rotation, at least a part of the second portion being translatable along a movement axis between a first position and a second position, the first portion being in the first orientation when the at least part of the second portion is in the first position, the first portion being in the second orientation when the at least part of the second portion is in the second position, the third portion being connected with the first portion and moving with the first portion between the first and second orientations, the third portion being movable with respect to the first portion in a direction transverse to the axis of rotation, the third portion being structured to be connected with a shaft that has a handle situated thereon, and the second portion having a number of lugs that are structured to engage a switch of a circuit interrupter of the number of circuit interrupters and to move the switch between a first state and a second state, the at least part of the second portion being structured to be in the first position when the switch is in the first state, the at least part of the second portion being structured to be in the second position when the switch is in the second state.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 2:
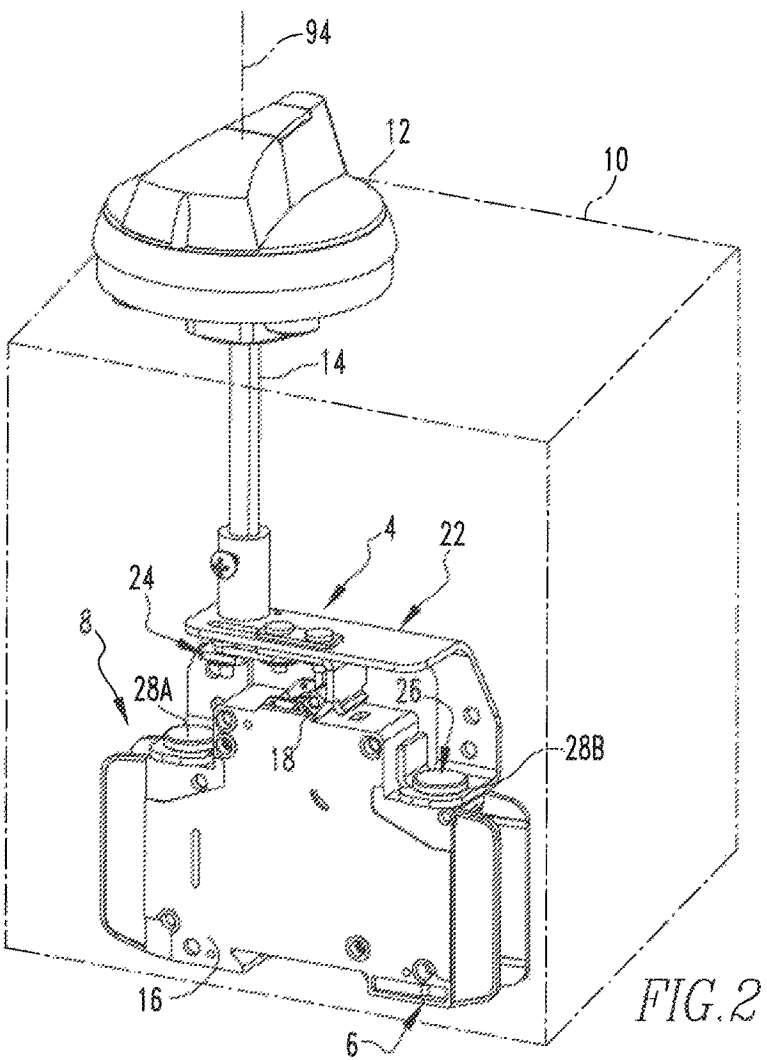
FIG. 2 is a view similar to FIG. 1, except depicting the rotary motion switching apparatus in a second position and depicting the circuit interrupter in a second state.
Figure 1:
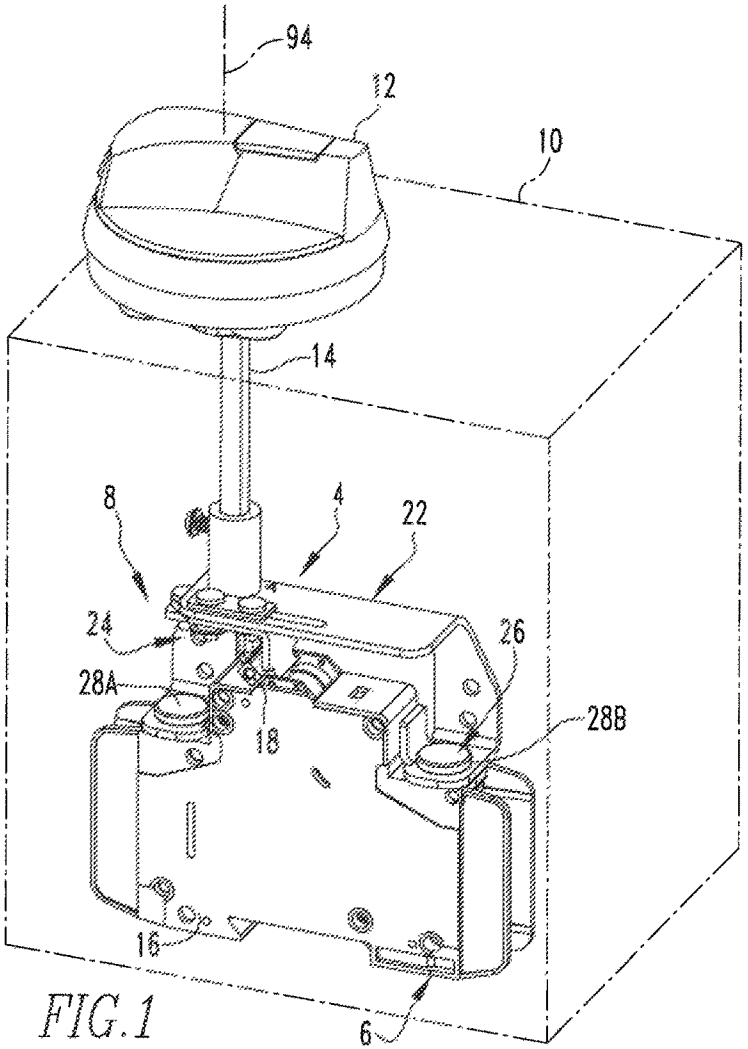
FIG. 1 is a perspective view of an improved rotary motion switching apparatus in accordance with a first embodiment of the disclosed and claimed concept situated on a circuit interrupter and being disposed inside a NEMA box that is depicted in phantom lines, with the rotary motion switching apparatus being in a first position and with the circuit interrupter being in a first state.
Figure 3:
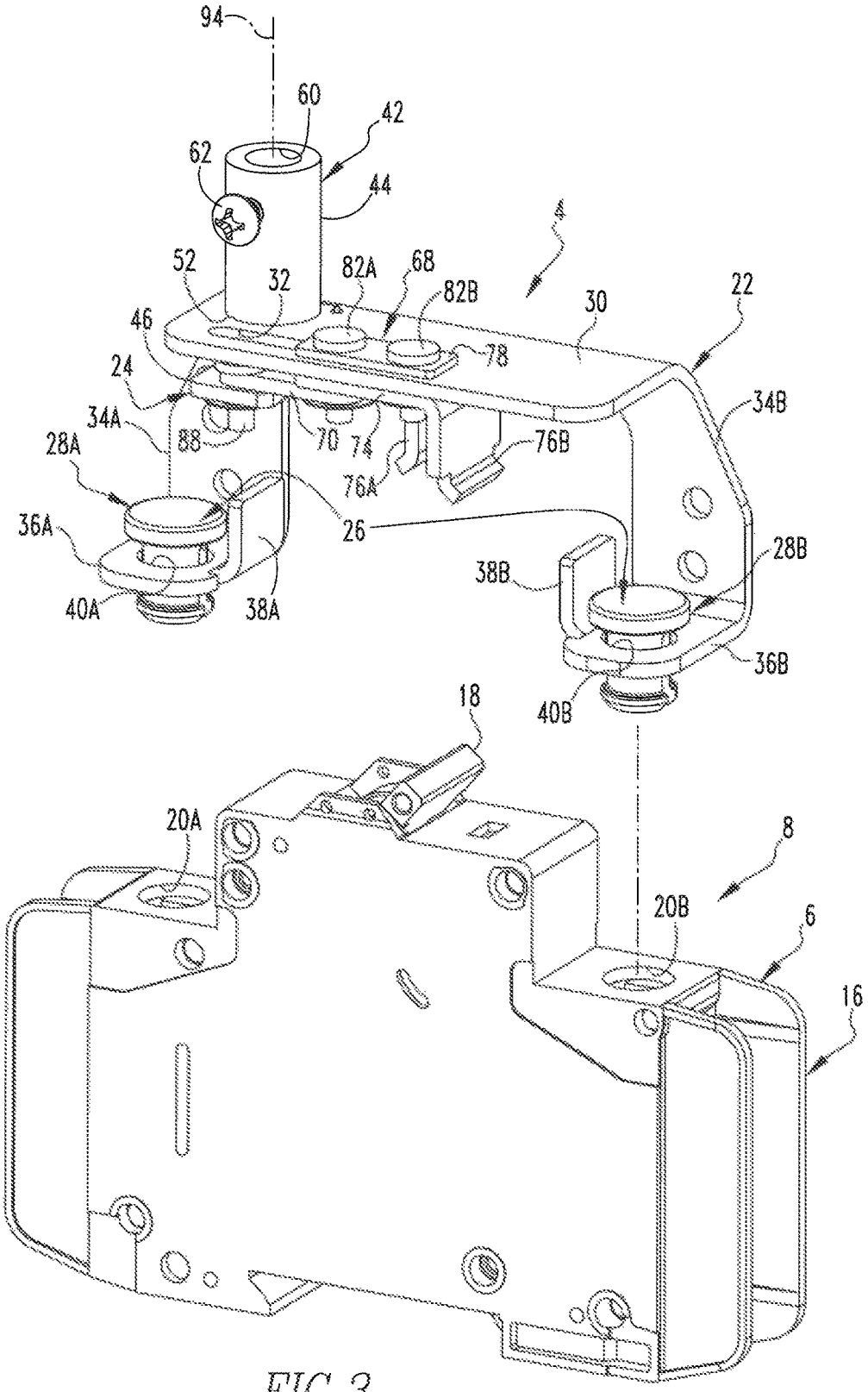
FIG. 3 is a view showing an improved assembly in accordance with the disclosed and claimed concept in which the rotary motion switching apparatus of FIG. 2 is exploded away from the circuit interrupter of FIG. 2.
Figure 4:
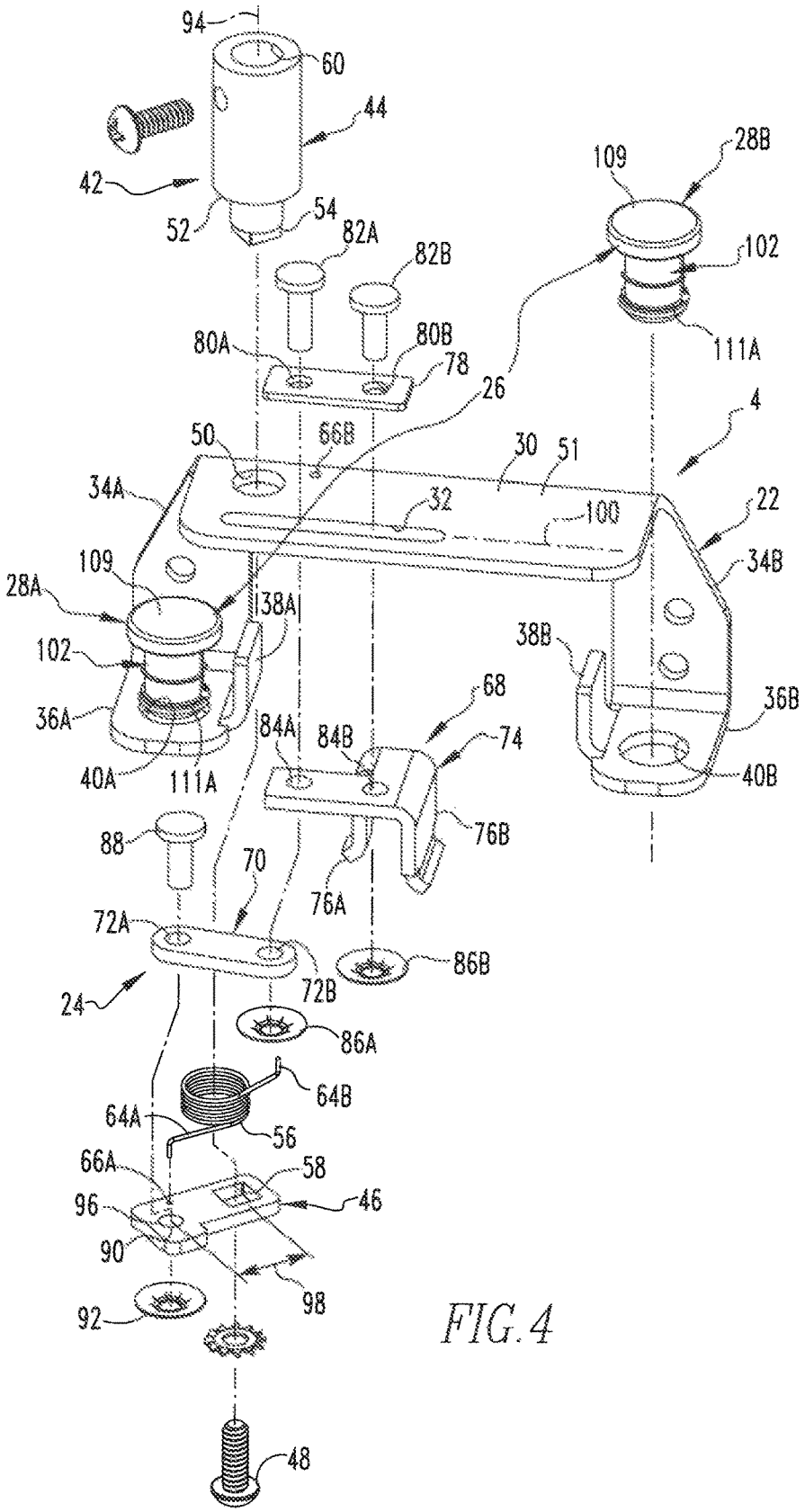
FIG. 4 is an exploded view of the rotary motion switching apparatus of FIG. 3.

An improved rotary motion switching apparatus 4, which may be alternatively referred to herein as the apparatus 4, is depicted in FIGS. 1-7 and is depicted in an exploded fashion in FIG. 4. The apparatus 4 is usable in conjunction with a circuit interrupter 6 such as is depicted in FIGS. 1-3 to form an assembly 8 that is likewise in accordance with the disclosed and claimed concept. Furthermore, the apparatus 4 is usable with a plurality of ganged circuit interrupters, such as are indicated at the numeral 106 in FIG. 7.

Figure 7:
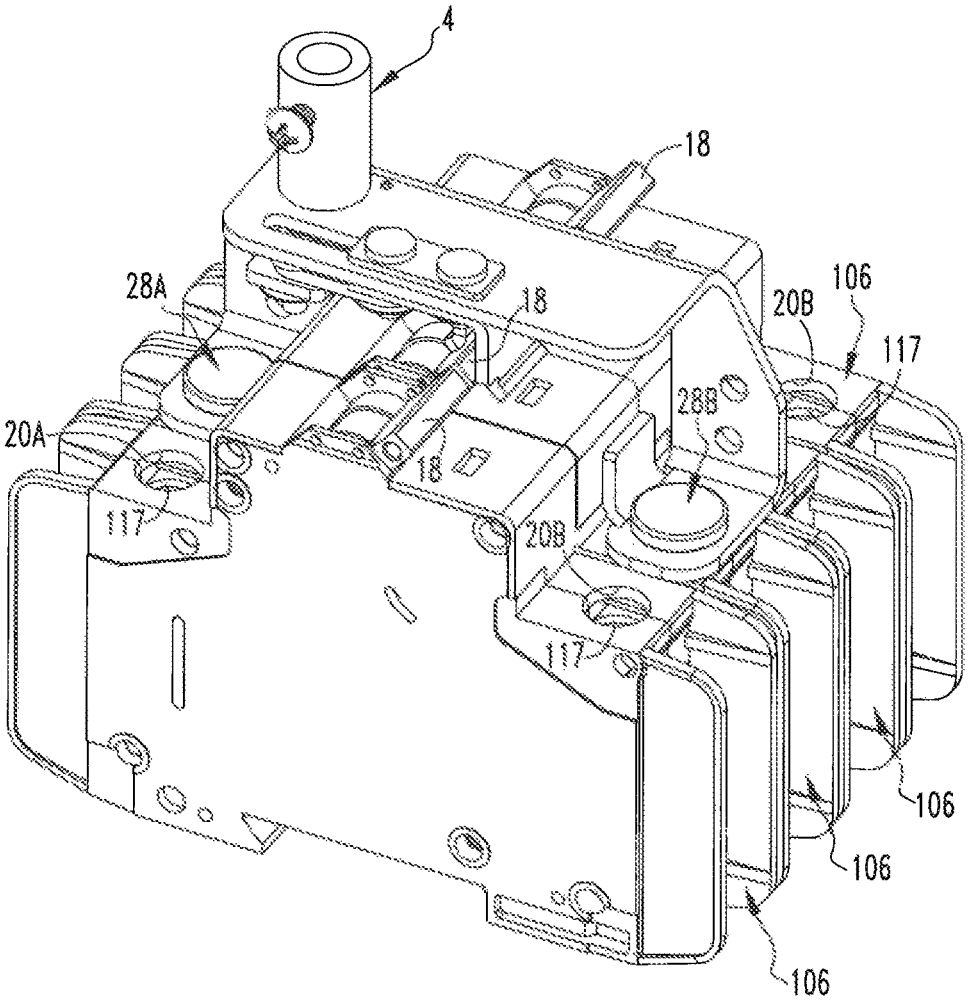
FIG. 7 is a view of the rotary motion switching apparatus being mounted to a circuit interrupter from among a plurality of circuit interrupters that are ganged together.

As can be understood from FIGS. 1 and 2, the apparatus 4 is usable in conjunction with the circuit interrupter 6 (or with multiple instances of circuit interrupters 106, such as are indicated in FIG. 7) to form the assembly 8 when the assembly 8 is used inside a NEMA box 10 that is indicated in FIGS. 1 and 2 in phantom lines. More specifically, the NEMA box 10 includes a handle 12 that is situated at an exterior of an enclosure of the NEMA box 10 and further includes a shaft 14 that is elongated, with one end of the shaft 14 being connected with the handle 12, and with an opposite end of the shaft 14 being connected with the apparatus 4. Depending upon the dimensions of the NEMA box 10, the shaft 14 can be cut to an appropriate length such that its opposite ends extend between the handle 12 and the apparatus 4.

As can be understood from FIGS. 1-3, the circuit interrupter 6 includes a housing 16 that is molded from an appropriate resin material or other material and a switch 18 that is movably situated on the housing 16. The switch 18 in the depicted exemplary embodiment is movable between an ON position and an OFF/TRIPPED position to switch the circuit interrupter 6 among a plurality of states in a well understood fashion. The housing 16 further includes a pair of openings formed therein that are indicated at the numerals 20A and 20B, and which may be collectively or individually referred to herein with the numeral 20. The openings 20 are provided in the housing 16 in order enable tools such as screwdrivers and the like to be receivable therein and to be cooperable with terminals of the circuit interrupter 6 that enable electrical connection between the circuit interrupter 6 and load conductor wires and other wires, by way of example.

As can be understood from FIG. 3, the apparatus 4 is provided separately from the circuit interrupter 6 and is mountable to the housing 16 of the circuit interrupter 6 by having portions thereof received in the openings 20. Since the openings 20 are pre-existing in the housing 16 for the reception of tools therein in order to connect wires with terminals of the circuit interrupter 6, the apparatus 4 advantageously is usable with the circuit interrupter 6 without requiring any modification of the housing 16 or of the mold that is used to form the housing 16, which is highly advantageous from a cost standpoint.

As can be understood from FIGS. 1-6, the apparatus 4 can be said to include a base 22, a crank apparatus 24 that is situated on the base 22, and an attachment system 26 that is mounted on the base 22 and which secures the apparatus 4 to the housing 16. In the depicted exemplary embodiment, the attachment system 26 includes a pair of connectors that are indicated at the numerals 28A and 28B, and which may be collectively or individually referred to herein with the numeral 28. When the connectors 28 are fully received in the openings 20, such as is indicated in FIGS. 1 and 2, the apparatus 4 is mounted to and affixed to the circuit interrupter 6.

As is best shown in FIG. 4, the base 22 can be said to include a main plate 30 in which an elongated slot 32 is formed. The base 22 further includes a pair of connection plates 34A and 34B, which may be collectively or individually referred to herein with the numeral 34, and that are connected with the main plate 30. The base 22 further includes a pair of base plates 36A and 36B, which may be collectively or individually referred to herein with the numeral 36, and which are connected with the connection plates 34A and 34B, respectively. The base 22 further includes a pair of tabs 38A and 38B, which may be collectively or individually to herein with the numeral 38, which are situated on the base plates 36A and 36B, respectively. The tabs 38 are in a confronting relationship with one another. The base plates 36A and 36B have formed therein a pair of holes 40A and 40B, respectively, and which may be collectively or individually referred to herein with the numeral 40. As can be understood from FIG. 4, the base plates 36 are oriented substantially parallel with the main plate 30, and the connection plates 34 are oriented substantially perpendicular to the main plate 30 and the base plates 36. When the apparatus 4 is mounted to the circuit interrupter 6 with the connectors 28 being fully received in the openings 20, the tabs 38 confrontingly engage therebetween a portion of the housing 16 such that the portion of the housing 16 is interposed between the tabs 38 to advantageously resist movement of the base 22 with respect to the housing 16 along a direction parallel with the longitudinal extent of the slot 32. As can be further understood from FIG. 4, the connectors 28A and 28B are receivable in the holes 40A and 40B, respectively.

As can further be understood from FIG. 4, the crank apparatus 24 includes a crank 42 which can be said to include a boss 44, a crank plate 46, and a screw 48. The screw 48 engages an underside of the crank plate 46 and fastens the crank plate 46 to the boss 44. The crank 42 can be said to constitute a first portion 42 of the crank apparatus 24.

The main plate 30 has an aperture 50 formed therein within which the boss 44 is receivable. When the crank 42 is installed on the base 22, a shoulder 52 of the boss 44 is receivable against an upper surface 51 of the main plate 30. The boss 44 can be said to include a tip 54 that is of a rectangular shape and which is receivable through a spring 56 and is receivable in a rectangular hole 58 that is formed in the crank plate 46. With the tip 54 received in such fashion in the rectangular hole 58, the screw 48 can be received in a threaded hole formed in the tip 54 in order to connect together the boss 44 and the crank plate 46 in a condition installed on the base 22.

As can further be understood from FIG. 4, the boss 44 can be said to have a receptacle 60 formed therein at an end thereof opposite the tip 54 and which is configured to receive therein the corresponding end of the shaft 14. The boss 44 further includes a set screw 62 that is receivable in a hole in the side of the boss 44 and which is configured to be tightened in the hole and to compressively engage a flat surface of the shaft 14 in order to affix the shaft 14 and the crank 42 together.

It can be seen that the spring 56 includes a pair of legs that are indicated at the numerals 64A and 64B, which may be collectively or individually referred to herein with the numeral 64. The legs 64A and 64B are received in a pair of openings 66A and 66B, respectively, and which may be collectively or individually referred to herein with the numeral 66. When the legs 64 are received in the openings 66, the openings 66 serve as seats for the legs 64 and which enable the spring 56 to rotationally bias the crank 42 in a desirable fashion that is tailored to the needs of the particular application. For instance, the spring 56 may rotationally bias the crank apparatus 24 toward an OFF or TRIPPED state of the circuit interrupter 6, by way of example and without limitation.

As can further be understood from FIG. 4, the crank apparatus 24 further includes a slider 68 and a link 70 which together can be said to form a second portion of the crank apparatus 24 that is cooperable with the first portion of the crank apparatus 24, i.e., the crank 42. The link 70 is pivotably connected with both the slider 68 and the crank 42 via pinned connections therebetween, as will be set forth in greater detail below. More specifically, the link 70 has formed therein a pair of holes 72A and 72B, which may be collectively or individually referred to herein with the numeral 72, and which receive therein pins that enable the pivotable connections to exist between the link 70 and each of the crank 42 and the slider 68.

The slider 68 can be said to include a main portion 74 having formed therein a pair of holes 84A and 84B, which may be collectively or individually referred to herein with the numeral 84. The slider 68 further includes a pair of lugs 76A and 76B, which may be collectively or individually referred to herein with the numeral 76, that are connected with the main portion 74 and that are cooperable with the switch 18 to move it among its various positions. The lugs 76 are in a confronting relationship with one another. The slider 68 further includes a fastening plate 78 that has formed therein a pair of holes 80A and 80B, which may be collectively or individually referred to herein with the numeral 80. The slider 68 further includes a pair of pins 82A and 82B, that are receivable in the holes 80 of the fastening plate, through the slot 32, and are receivable in the holes 84 and which are cooperable with a pair of locking fasteners 86A and 86B. It is noted, however, that the pin 82A is additionally received through the hole 72B in the link 70 before being connected with the locking fastener 86A. The locking fastener 86A receives the pin 82A in a locking opening formed therein and is receivable against an underside of the link 70 adjacent the hole 72B. In a like fashion, the locking fastener 86B receives the pin 82B in a locking opening formed therein and is receivable against an underside of the main portion 74. In such a fashion, the slider 68 is mounted to the base 22 and is slidably translatable along the main plate 30 via sliding movement of the pins 82 within the slot 32. Furthermore, the link 70 is pivotably connected with the slider 68.

The crank apparatus 24 further includes a pin 88 that is receivable in the hole 72A in the link 70 and that is further received through a hole 90 that is formed in the crank plate 46. The pin 88 is further received in a locking opening of a locking fastener 92 that is receivable against an underside of the crank plate 46 to provide the pivotable connection between the link 70 and the crank 42.

As can be understood from the accompanying figures, the crank 42 is rotatable about an axis of rotation 94 between a first orientation such as is depicted generally in FIG. 1 and a second orientation such as is depicted generally in FIG. 2. The axis of rotation 94 extends through the rectangular hole 58 formed in the crank plate 46 and further extends through the aperture 50 formed in the main plate 30. The hole 90 in the crank plate 46 is situated at a location 96 that is spaced a distance 98 from the axis of rotation 94. Since the link 70 is pivotably connected between the crank 42 and the slider 68, it can be understood that rotational movement of the crank 42 about the axis of rotation 94 is converted via the link 70 being connected with the crank 42 at the location 96 spaced the distance 98 from the axis of rotation 94 into translational movement of the slider 68 within the slot 32 along a movement axis 100 that is parallel with the slot 32. More specifically, and as can be understood from FIGS. 1 and 2, when the crank 42 is in its first orientation, such as is depicted in FIG. 1, the slider 68 is in a first position. In a like fashion, when the crank 42 is in its second orientation, such as is depicted generally in FIG. 2, the slider 68 is in a second position. Since the crank apparatus 24 transforms rotational movement of the handle 12 and the shaft 14 applied to the crank 42 into translational movement of the slider 68 along the movement axis 100, it can be seen that such rotation of the handle 12 causes the lugs 76 to engage the switch 18 of the circuit interrupter 6 and to move the switch 18 among its various positions, which changes the circuit interrupter 6 among its various states.

Figure 5:
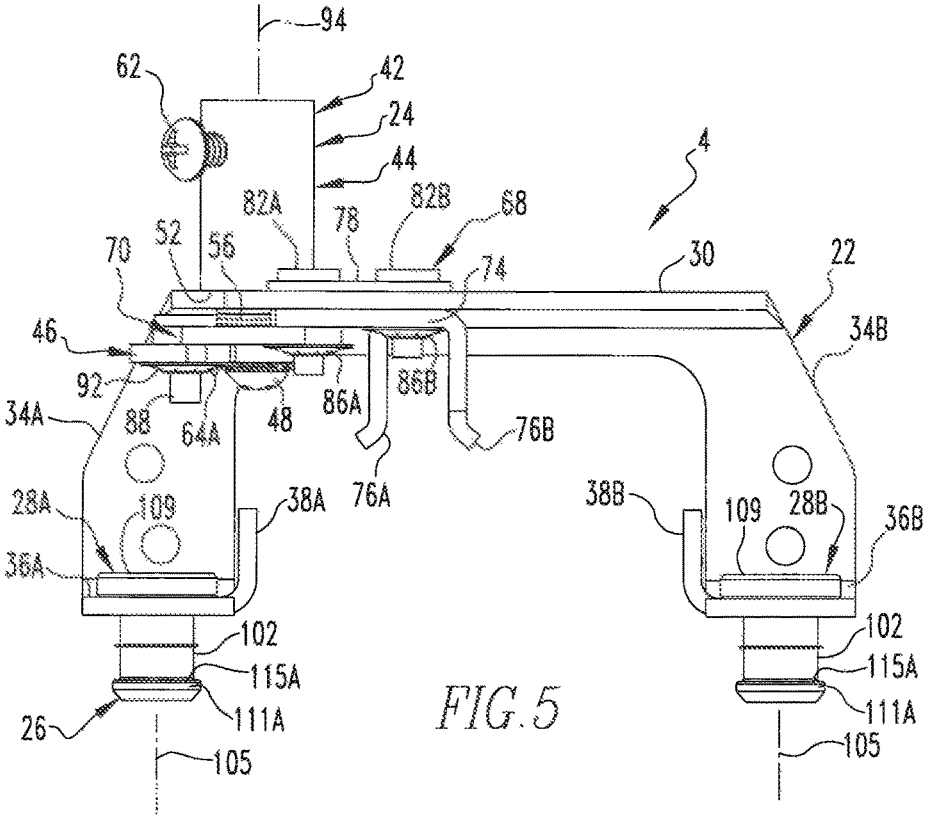
FIG. 5 is a front elevational view of the rotary motion switching apparatus.
Figure 6:
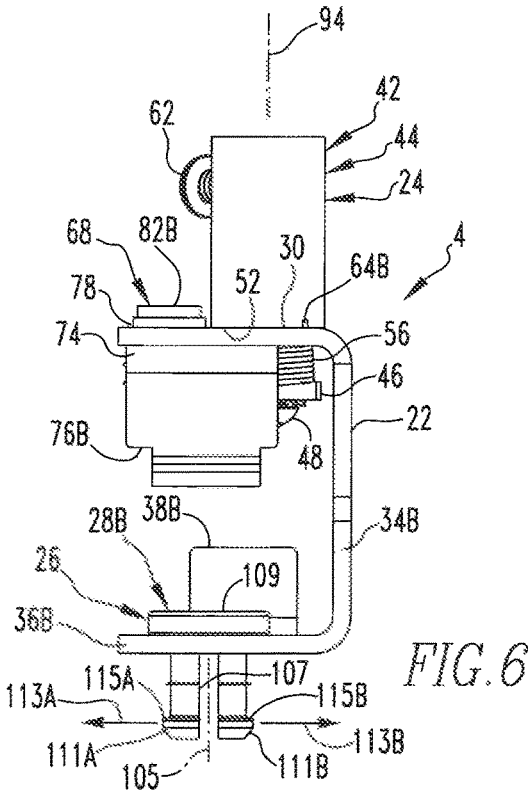
FIG. 6 is a side elevational view of the rotary motion switching apparatus.

As is best shown in FIGS. 4-6, the connectors 28 can be said to each include an elongated body 102 that is elongated along a direction of elongation 105 and which has formed therein an elongated notch 107 that is elongated along the direction of elongation 105. Each connector 28 further includes a head 107 at one end thereof and a pair of latches that are situated thereon opposite the head 109 and which are indicated at the numerals 111A and 111B, which may be collectively or individually referred to herein with the numeral 111. The latches 111A and 111B extend away from the notch 107 in a pair of directions that are indicated at the numerals 113A and 113B, respectively, and which may be collectively or individually referred to herein with the numeral 113. In the depicted exemplary embodiment, the directions 113 are each perpendicular to the direction of elongation 105 and are opposite one another.

The latches 111A and 111B each have an engagement surface 15A and 115B, respectively, which may be collectively or individually referred to herein with the numeral 115. In the depicted exemplary embodiment, the engagement surfaces 115 are of a generally planar configuration and are oriented perpendicular to the direction of elongation 105. When the connectors 28 are fully received in the openings 20, the engagement surfaces 115 engage a structure 117 of the housing that is best shown in FIG. 7. In the depicted exemplary embodiment, the structure 117 is an annular flange that is situated adjacent the opening 20 and that confrontingly engages the engagement surfaces 115 when the connectors 28 are received in the openings 20. Such engagement between the engagement surfaces 115 and a corresponding surface of the structure 117 advantageously resists removal of the connectors 28 from the openings 20 and thus likewise resists removal of the apparatus 4 from the circuit interrupter 6. In such a situation, the engagement surfaces 115 directly confront and engage a corresponding confronting surface of the structure 117 and thus enable the connectors 28 to remain affixed to the housing 16 within the openings 20.

It is noted that the direction of elongation 113 is substantially parallel with the axis of rotation 94 such that any reaction of the rotation of the handle 12 that is applied to the connectors 28 results in the bodies 102 compressively engaging the housing 16 within the openings 20 rather than applying forces between the engagement surfaces 115 and the structures 117. As such, any forces that may be applied to the connectors 28 as a result of application of a torque to the handle 12 at most further engage the bodies 102 with the housing 16 within the openings 20 without compromising the connection between the engagement surfaces 115 and the structures 117. Furthermore, it is noted that the engagement of the tabs 38 with the housing 16 resists the application of any meaningful torque to the connectors 28 due to rotation of the handle 12.

It thus can be seen that the apparatus 4 is affixable to the circuit interrupter 6 by receiving the connectors 28 in the openings 20, which enables the apparatus 4 to be affixed to the circuit interrupter 6 using the pre-existing openings 20 and without a need of modifying the housing 16 or the tooling that is used to form the housing 16. The apparatus 4 converts rotary motion of the handle 12 of the NEMA box 10 into translation of the slider 68 which is cooperable with the switch 18 to move the circuit interrupter 6 among its various states. This provides an advantageously workable solution at relatively low cost.

As noted above, and as can be seen in FIG. 7, the rotary switching apparatus 4 is connectable with a plurality of circuit interrupters 106 that are ganged together, with four of the circuit interrupters 106 being depicted in FIG. 7 as being ganged together. The apparatus 4 can be mounted to any one of the circuit interrupters 106 in the fashion set forth above, namely be receiving the connectors 28 in the openings 20, in order to be cooperable with the switch 18 of that circuit interrupter 106 to thereby effect simultaneous movement of all of the circuit interrupters 106 among their various states. Depending upon limitations of the circuit interrupters 106 themselves, it may be more desirable to mount the apparatus 4 to one of the two inboard-situated circuit interrupters 106, such as is shown in FIG. 7, rather than being affixed to one of the two outboard-situated circuit interrupters 106, although such position is not intended to be limiting and is provided merely as an example.

It thus can be seen that the apparatus 4 is relatively simple and inexpensive to manufacture and does not require any modification of the housings 16 in order to be affixable to the circuit interrupter 6. The attachment of the connectors 28 in the openings 20 with the heads 109 being received against the baseplates 36 and with the bodies 102 being received through the holes 40 and into the openings 20 with the engagement surfaces 115 being engaged with corresponding confronting surfaces of the structures 117 causes the apparatus 4 to be affixed to the circuit interrupter 6. Such affixing of the apparatus 4 to the circuit interrupter 6 employs the pre-existing openings 20 and thus avoids the need for a modification of the housing 16 or a modification of the tooling that is used to make the housing 16, which is cost advantageous. Other advantages will be apparent.

Figure 8:
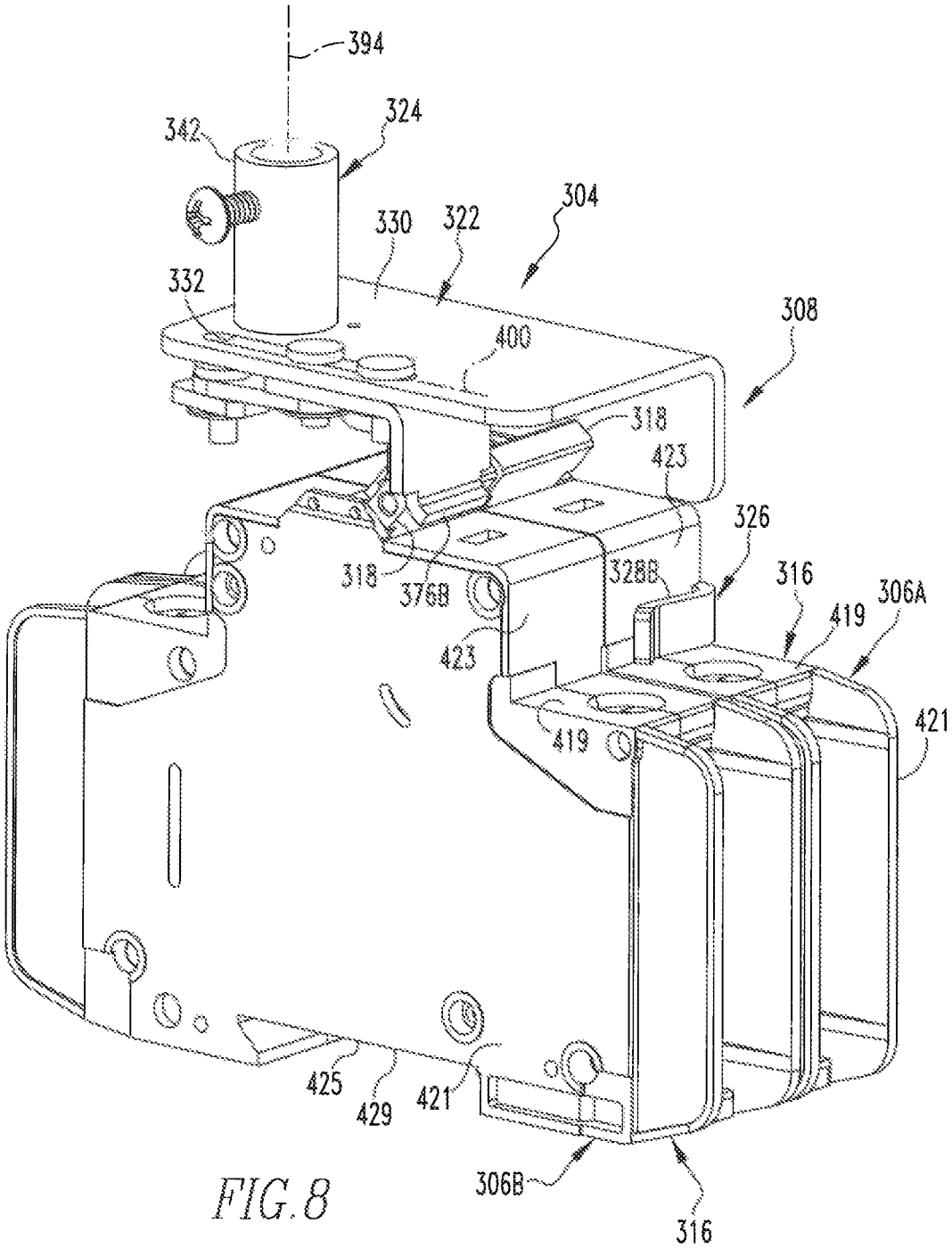
FIG. 8 is a perspective view of an improved rotary motion switching apparatus in accordance with a second embodiment of the disclosed and claimed concept situated on a pair of circuit interrupters and thus depicting another improved assembly in accordance with the disclosed and claimed concept.
Figure 9:
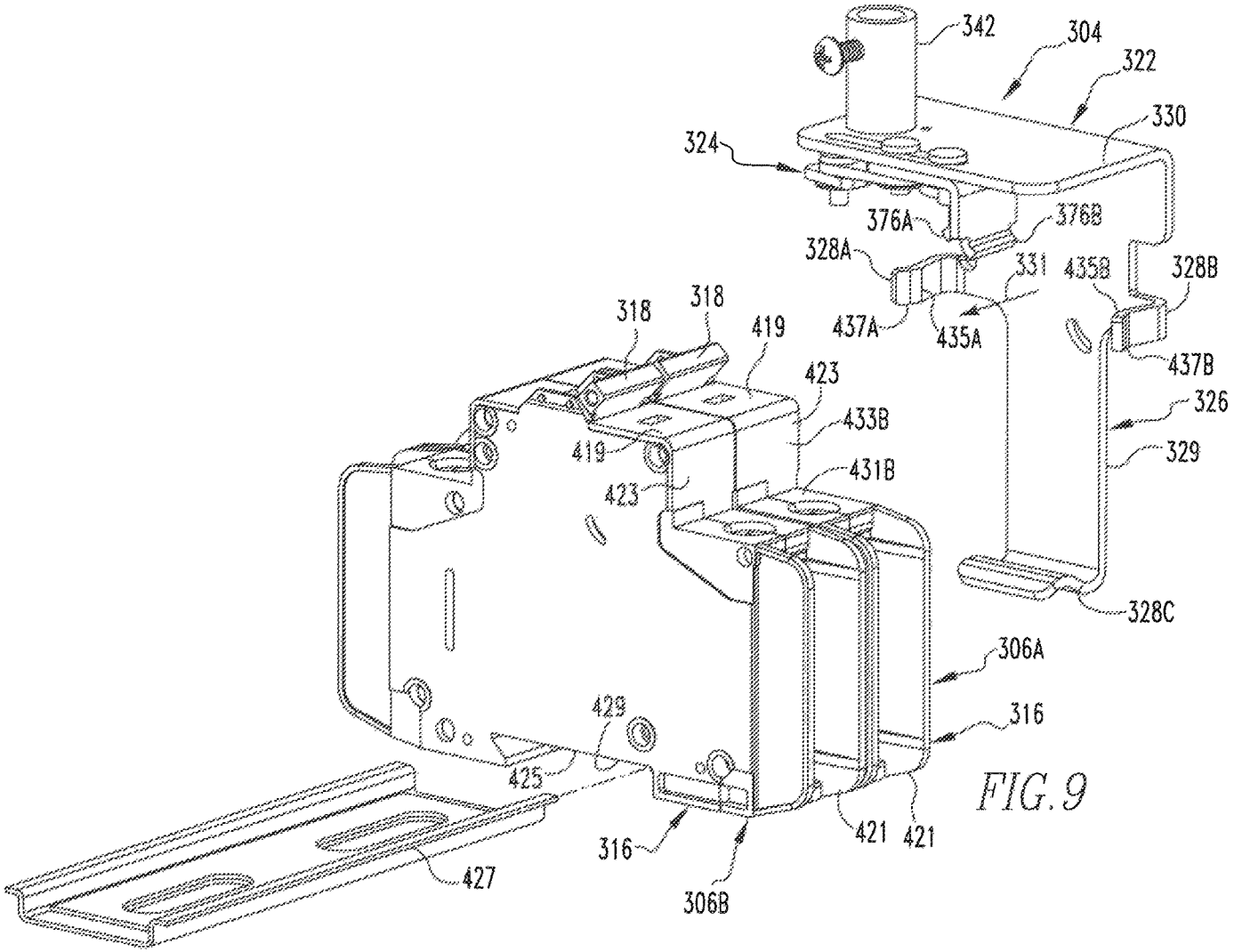
FIG. 9 is view similar to FIG. 8, except depicting the rotary motion switching apparatus exploded away from the pair of circuit interrupters and further depicting a NEMA rail exploded away from the pair of circuit interrupters.
Figure 10:
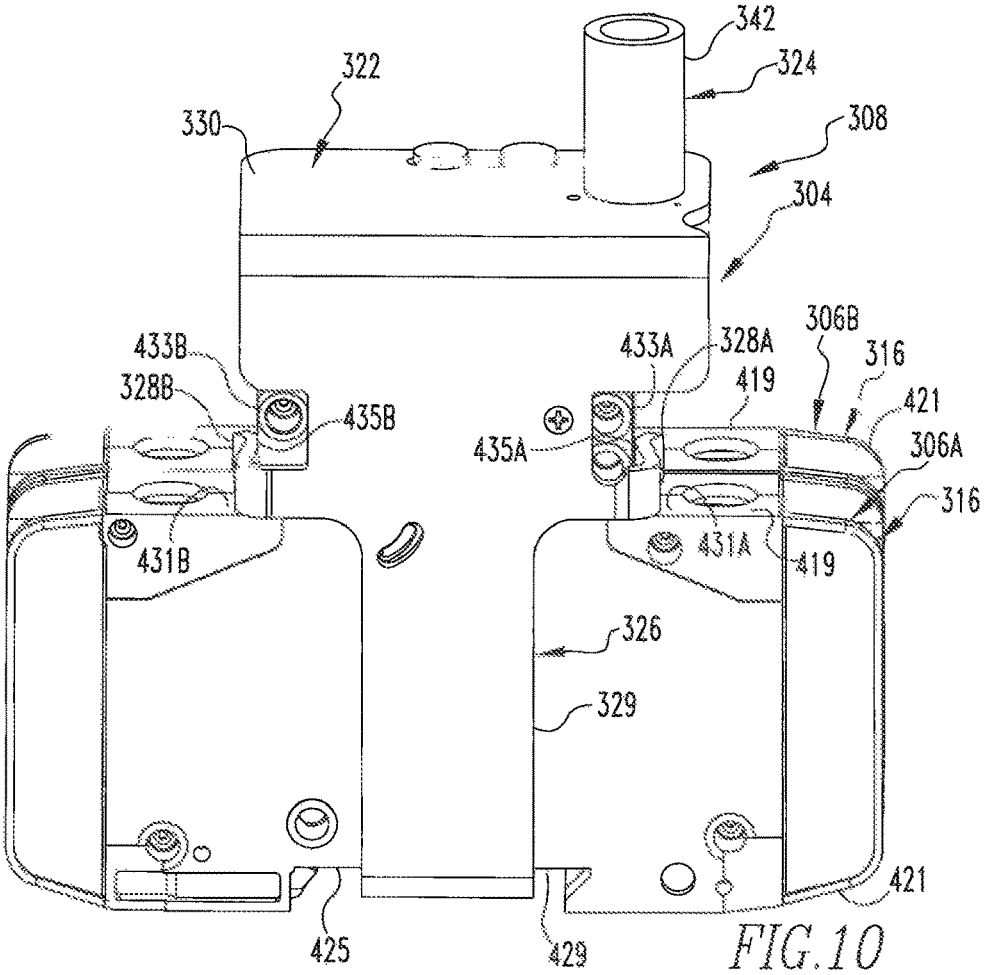
FIG. 10 is a top rear view of the apparatus of FIG. 8.
Figure 11:
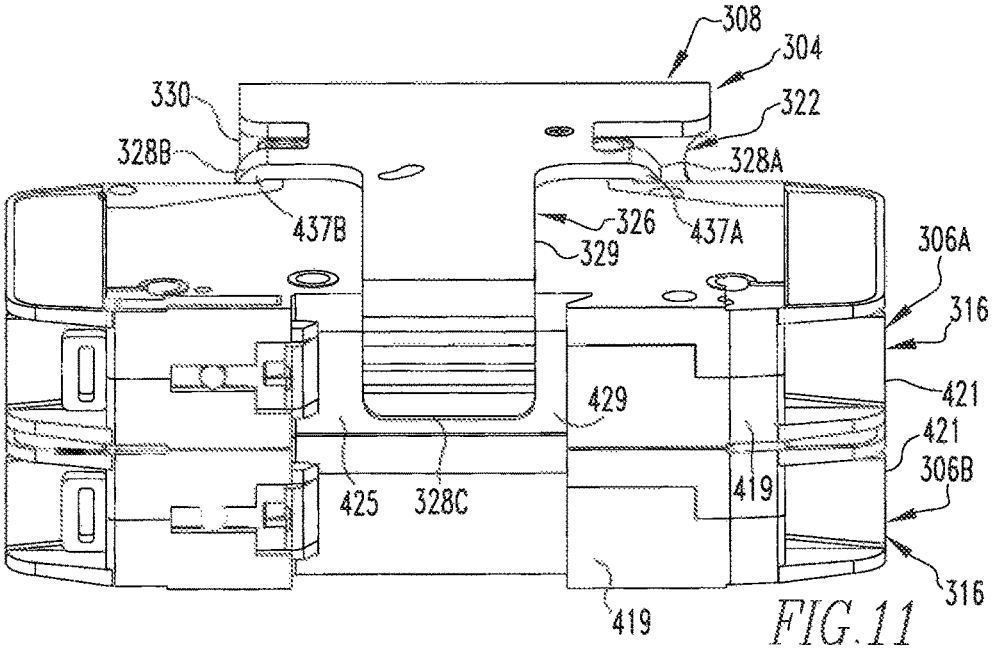
FIG. 11 is a bottom rear view of the apparatus of FIG. 8.
Figure 12:
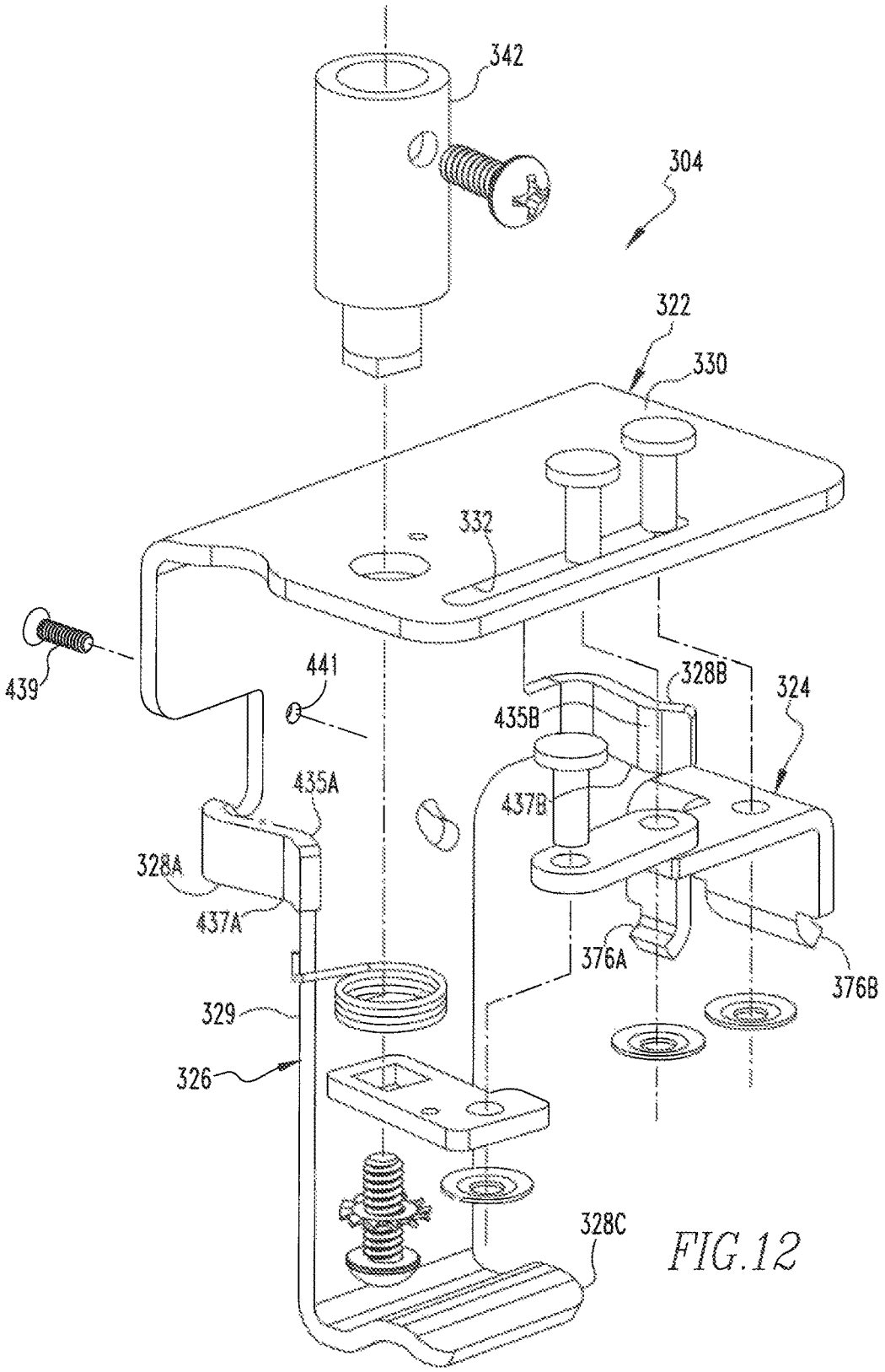
FIG. 12 is an exploded view of the apparatus of FIG. 8.
Figure 13:
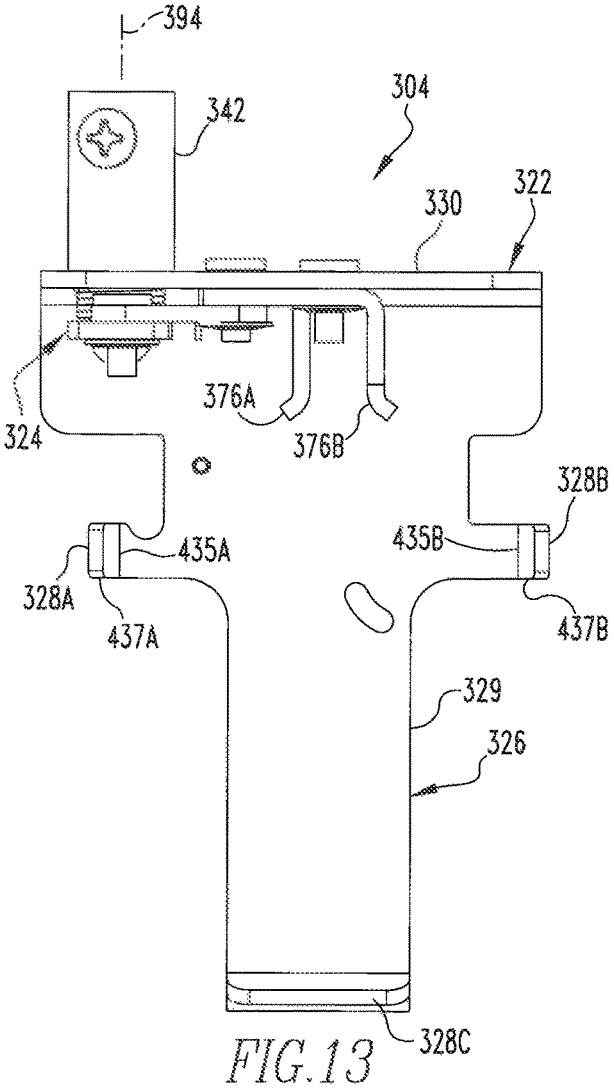
FIG. 13 is a front elevational view of the apparatus of FIG. 8.
Figure 14:
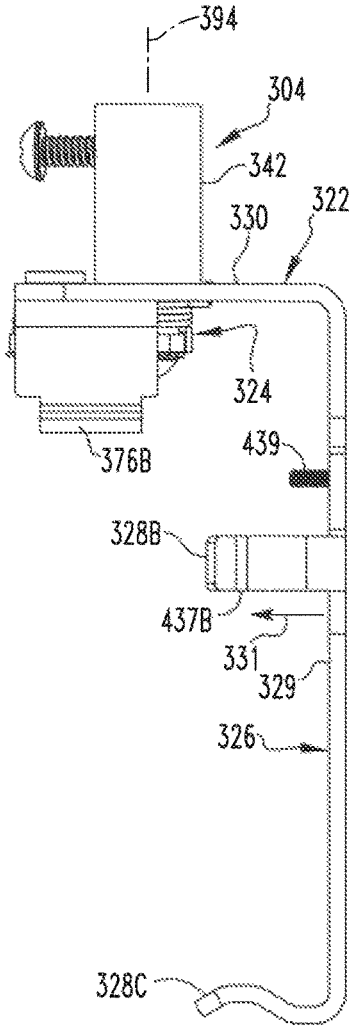
FIG. 14 is a right side elevational view of the apparatus of FIG. 8.
Figure 15:
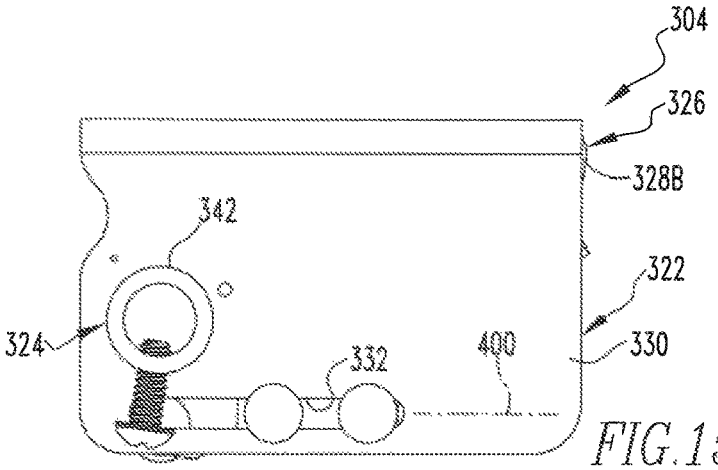
FIG. 15 is a top plan view of the apparatus of FIG. 8.

An improved rotary motion switching apparatus 304 in accordance with a second embodiment of the disclosed and claimed concept is depicted generally in FIGS. 8-15. The apparatus 304 is depicted in FIGS. 8, 10, and 11 as being mounted to a pair of circuit interrupters that are indicated at the numerals 306A and 306B. The apparatus 304 in combination with the circuit interrupters 306A and 306B forms an improved assembly 308 that is in accordance with the disclosed and claimed concept. As noted above, the apparatus 4 is mountable to a number of circuit interrupters 6 to form the assembly 8 which can have a handle 12 and shaft 14 mounted thereto and be received in a NEMA box 10, as is indicated in FIGS. 1 and 2. It is noted that the apparatus 304 and, more specifically, the assembly 308 can likewise be received in a NEMA box 10 and have a shaft 14 and handle 12 mounted thereto in a similar fashion. It is further noted that the apparatus 304 is likewise movable between a first position and a second position to move the circuit interrupters 306A and 306B between a first state and a second state, respectively. In the depicted exemplary embodiment of the apparatus 304, the apparatus 304 is mounted to the circuit interrupter 306A and operates a switch 318 of the circuit interrupter 306B, with the circuit interrupters 306A and 306B being ganged together to cooperatively move between the first and second states. It is noted, however, that the apparatus 304 can be modified to operate solely with a single circuit interrupter, i.e., to be mounted to a single circuit interrupter and to be directly cooperable with the switch of that same circuit interrupter, by way of example and without limitation. Moreover, it is noted that additional circuit interrupters can likewise be ganged together with the circuit interrupters 306A and 306B to cooperatively move between the first and second states without departing from the spirit of the instant disclosure.

As can be understood from FIG. 8, the circuit interrupters 306A and 306B each include a housing 316 and further include a switch 318 that is situated on the housing 316. The circuit interrupters 306A and 306B are each similar to the circuit interrupter 6, by way of example and without limitation.

The apparatus 304 can be said to include a base 322 and to further include a crank apparatus 324 that is situated on the base 322. The crank apparatus 324 is substantially the same as the crank apparatus 24. The apparatus 304 further includes an attachment system 326 that is situated on the base 322. As will be set forth in greater detail below, the attachment system 326 is cooperable with the housing 316 in order to secure the apparatus 304 to the circuit interrupter 306A, by way of example, without a need to modify the housing 316 thereof or to modify the tooling or molds from which the housing 316 is formed.

The attachment system 326 can be said to include a plurality of connectors that are indicated at the numerals 328A, 328B, and 328C, which may be collectively or individually referred to herein with the numeral 328, and a support 329 that is of a plate-like configuration. The base 322 can be said to include a platform 330 that is situated at an end of the support 329. As a general matter, the platform 330 is of a plate-like configuration, and it can be seen from the accompanying figures that the support 329 and the platform 330 are situated generally orthogonal to one another.

The connectors 328A and 328B are situated on the support 329 at opposite sides thereof and the connector 328C is situated on the support 329 at another end thereof opposite the platform 330. The connectors 328A and 328B are disposed on the support 329 at a location between the platform 330 and the connector 328C. The connectors 328 each extend in a common direction 331 (FIG. 9) away from the support 329, and it can be seen that the platform 330 likewise extends in the common direction 331 away from the support 329.

As can be understood from the accompanying figures, the platform 330 has a slot 332 formed therein that is elongated along a movement axis 400. The crank apparatus 324 includes a crank 342 that is pivotably situated on the platform 330 and that is cooperable with a pair of lugs 376A and 376B that are engageable with the switch 318 of the circuit interrupter 306B. More specifically, the crank 342 is rotatable about an axis of rotation 394 between first and second orientations to move the pair of lugs 376A and 376B along the slot 330 between first and second positions along the movement axis 400 to switch the circuit interrupters 306A and 306B between first and second states, respectively. Such movement is very much like the movement of the crank apparatus 24 set forth above.

With regard to the attachment system 326, it can be understood that the housing 316 of each circuit interrupter 306A and 306B includes an exterior surface 419. Furthermore, each housing 316 can be said to include a main portion 421 and to further include a protruding portion 423 that protrudes away from the main portion 421. The main portion 421 further has a notch 425 formed therein opposite the protruding portion 423 which is structured to receive therein a NEMA rail 427 (FIG. 9) of the NEMA box 10 to mount the assembly 308 to the NEMA box 10 within the interior of the NEMA box 10 (such as is depicted in FIGS. 1 and 2 in the context of the assembly 8). The exterior surface 419 includes a notch surface 429 within the notch 425.

The exterior surface 419 on the main portion 421 can be said to include a pair of surfaces 431A and 431B that are situated adjacent the protruding portion 423 at opposite ends thereof. Furthermore, the exterior surface 419 in the vicinity of the surfaces 431A and 431B can be said to include a pair of surfaces 433A and 433B on the protruding portion 423 and situated adjacent the surfaces 431A and 431B, respectively, of the main portion 421. The connectors 328A and 328B can be said to have a set of confronting faces 435A and 435B, respectively, which face generally toward one another. The connectors 328A and 328B further include a set of lower edges 437A and 437B, respectively, that are situated adjacent the confronting faces 435A and 435B, respectively.

When the attachment system 326 is situated on the housing 316, the connectors 328A and 328B are engaged with the housing 316 at the intersection of the main portion 421 and the protruding portion 423, and the connector 328C is engaged with the housing 316 at the notch surface 429. More specifically, the confronting faces 335A and 335B are engaged with the surfaces 433A and 433B of the protruding portion 423 to compressively retain the protruding portion 423 between the confronting faces 435A and 435B. In this regard, the attachment system 326 is formed such that the connectors 328A and 328B, when engaged with the protruding portion 423, bias the confronting faces 435A and 435B into engagement with the surfaces 433A and 433B to compressively engage the surfaces 433A and 433B and to compressively retain the protruding portion 423 between the connectors 328A and 328B.

Furthermore, when the connector 328B is received in the notch 425 and is engaged with the notch surface 429, the lower edges 437A and 437B of the connectors 328A and 328B, respectively, are engaged with the surfaces 431A and 431B of the main portion 421. When the attachment system 326 is situated on the housing 316 in such a fashion, the connector 328C is biased toward the notch surface 429 to compressively retain the main portion 421 between the connector 328C and the connectors 328A and 328B. That is, the attachment system 326 is configured such that the connector 328C is biased toward the notch surface 429 when the connectors 328 are engaged with the housing 316. The connector 328C is configured such that it does not interfere with the NEMA rail 427, which enables the NEMA rail 427 to be received in the notch 425 after the connector 328C has been received in the notch and engaged with the notch surface 429.

It thus can be seen that the engagement of the three connectors 328 with the housing 316 secures the apparatus 304 onto to the circuit interrupter 306A and thus resists relative movement between the apparatus 304 and the circuit interrupters 306A and 306B when, for example, the crank 342 is rotated to cause the lugs 376A and 376B to move the circuit interrupters 306A and 306B between their first and second states. The connectors 328 thus engage portions of the exterior surface 419 of the housing 316 to enable such mounting without a need to modify the housing 316 or the tooling or molds that are used to manufacture the housing 316, which saves expense.

To further affix the apparatus 304 to the housing 316 of the circuit interrupter 306A, an optional screw 439 (FIG. 12) can be received through a hole 441 formed in the support 329 and received in a corresponding pre-existing opening formed in the housing 316. Depending upon the needs of the application, the screw 439 may provide an additional measure of securement between the apparatus 304 and the circuit interrupters 306A and 306B. It is understood that the connectors 328 sufficiently affix the apparatus 304 to the circuit interrupter 306A such that the screw 439 is completely optional. It is further understood that the opening formed in the housing with which the screw 439 is cooperable was pre-existing in the housing 316 and thus likewise enables mounting of the apparatus 304 to the circuit interrupter 306A without a need to modify the housing 316 or the tooling or molds that are used to manufacture the housing 316, which similarly saves expense.

It thus can be seen that the switching apparatus 304 is affixable to the circuit interrupter 306A and, in turn, to the circuit interrupter 306B, and is usable to switch the circuit interrupter 306B, and thus also the circuit interrupter 306A, between its various states. It accomplishes this without a need to modify the housing 316 or the tooling or molds that were used to form the housing, which advantageously saves cost. Other benefits will be apparent.

Figure 16:
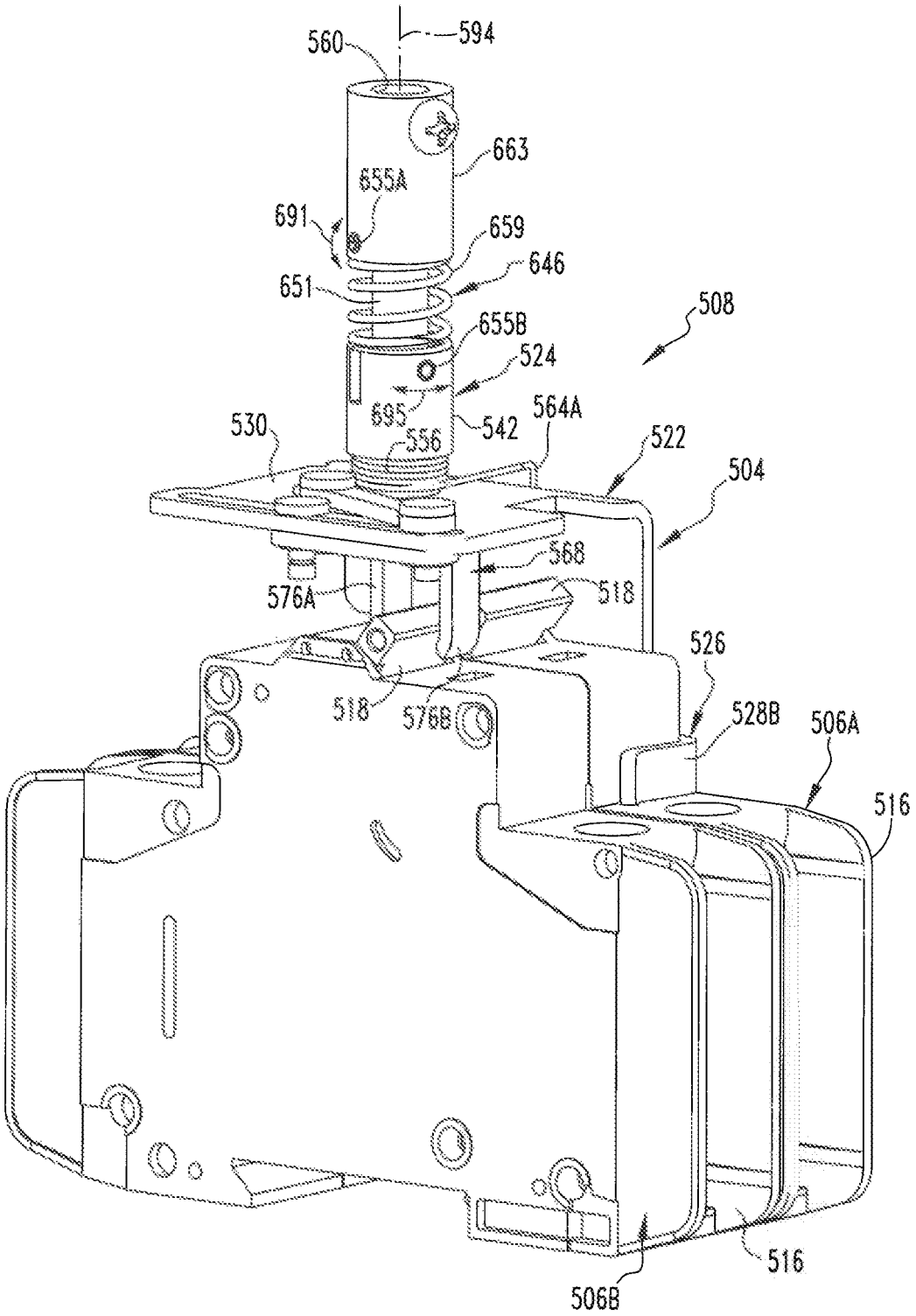
FIG. 16 is a perspective view of an improved rotary motion switching apparatus in accordance with a third embodiment of the disclosed and claimed concept situated on a pair of circuit interrupters and thus depicting a further improved assembly in accordance with the disclosed and claimed concept.
Figure 17:
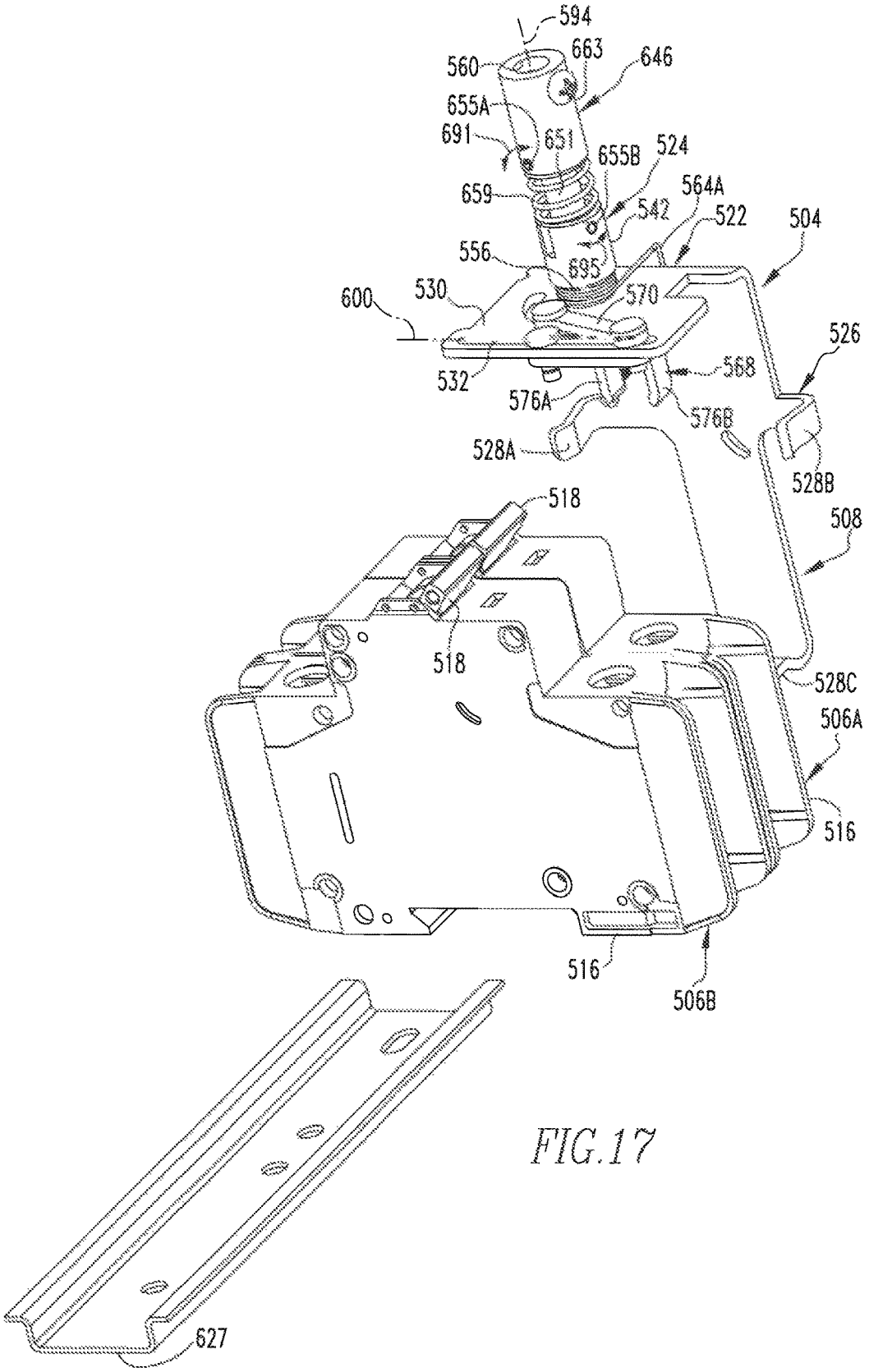
FIG. 17 is view similar to FIG. 16, except depicting the rotary motion switching apparatus exploded away from the pair of circuit interrupters and further depicting a NEMA rail exploded away from the pair of circuit interrupters.

An improved rotary motion switching apparatus 504 in accordance with a third embodiment of the disclosed and claimed concept is depicted generally in FIGS. 16-19. The apparatus 504 is depicted in FIG. 16 as being mounted to a pair of circuit interrupters that are indicated at the numerals 506A and 506B. The apparatus 504 in combination with the circuit interrupters 506A and 506B forms an improved assembly 508 that is likewise in accordance with the disclosed and claimed concept. As has been noted above, the apparatus 4 is mountable to a number of circuit interrupters 6 to form the assembly 8 which can have a handle 12 and a shaft 14 mounted thereto and be received in a NEMA box 10, as is indicated in FIGS. 1 and 2. It is noted that the apparatus 504 and, more specifically, the assembly 508 can likewise be received in a NEMA box 10 and can have a shaft 14 and handle 12 mounted thereto in a similar fashion. It is further noted that the apparatus 504 is likewise movable between a first position and a second position to move the circuit interrupters 506A and 506B between a first state and a second state, respectively. In the depicted exemplary embodiment of the apparatus 504, the apparatus 504 is mounted to a housing 516 the circuit interrupter 506A and operates a switch 518 of the circuit interrupter 506B, with the circuit interrupters 506A and 506B being ganged together to cooperatively move between the first and second states. It is noted, however, that the apparatus 504 can be modified to operate solely with a single circuit interrupter or to be cooperable with more than two circuit interrupters without departing from the spirit of the instant disclosure. The circuit interrupters 506A and 506B are likewise cooperable with a NEMA rail 627, as in FIG. 17, that is situated within the NEMA box 10 that is depicted in FIGS. 1 and 2.

The apparatus 504 can be said to include a base 522 and to further include a crank apparatus 524 that is situated on the base 522. The apparatus 504 further includes an attachment system 526 that is situated on the base 522. The base 522 and the attachment system 526 are substantially the same as the base 322 and the attachment system 326, respectively, with the attachment system 526 including a plurality of connectors that are indicated at the numerals 528A, 528B, and 528C which engage the circuit interrupter 506A. The attachment system 526 is cooperable with the housing 516 in the same way as the attachment system 326 is with the housing 316 in order to secure the apparatus 504 to the circuit interrupter 506A, by way of example, without a need to modify the housing 516 thereof or to modify the tooling or molds from which the housing 516 is formed.

As can be understood from the accompanying figures, the base 522 includes a platform 530 which has a slot 532 formed therein that is elongated along a movement axis 600. The crank apparatus 524 includes a crank 542 that is pivotably situated on the platform 530 and that is cooperable with a pair of lugs 576A and 576B that are engageable with the switch 518 of the circuit interrupter 506B. More specifically, the crank 542 is rotatable about an axis of rotation 594 between first and second orientations to move the pair of lugs 576A and 576B along the slot 530 between first and second positions along the movement axis 500 to switch the circuit interrupters 506A and 506B between first and second states, respectively. Such movement is very much like the movement of the crank apparatus 24 and the movement of the crank apparatus 324 set forth above.

The crank apparatus 524 is similar to the crank apparatus 24 and the crank apparatus 324, except that the crank apparatus 524 is configured to additionally include a universal joint 646 that is situated on the crank 542. The crank 542 serves as a first portion that is pivotably connected at a distance from the axis of rotation 594 with a link 570 that is pivotably connected with the slider 568. The slider 568 functions as a second portion of the crank apparatus 524. The crank apparatus 524 additionally includes the universal joint 646 which serves as a third portion of the crank apparatus 524 and that is, in the depicted exemplary embodiment, not only connected with the crank but is situated on the crank 542.

The universal joint 646 can be said to include an elongated connection bar 651, a pair of roll pins 655A and 655B, a spring 659, and a mount 663. The mount 663 has a receptacle 560 formed therein that is structured to receive an end of a shaft, such as the shaft 14 which may have a handle 12 mounted thereon at the end opposite that which is received in the receptacle 560 when the assembly 508 is received in the NEMA box 10, such as that which is depicted generally in FIGS. 1 and 2. As will be set forth in greater detail below, the universal joint 646 advantageously permits the mount 663 and thus the shaft that is mounted therein to be movable with respect to the crank 542 and the base 522 in directions transverse to the axis of rotation 594.

Figure 18:
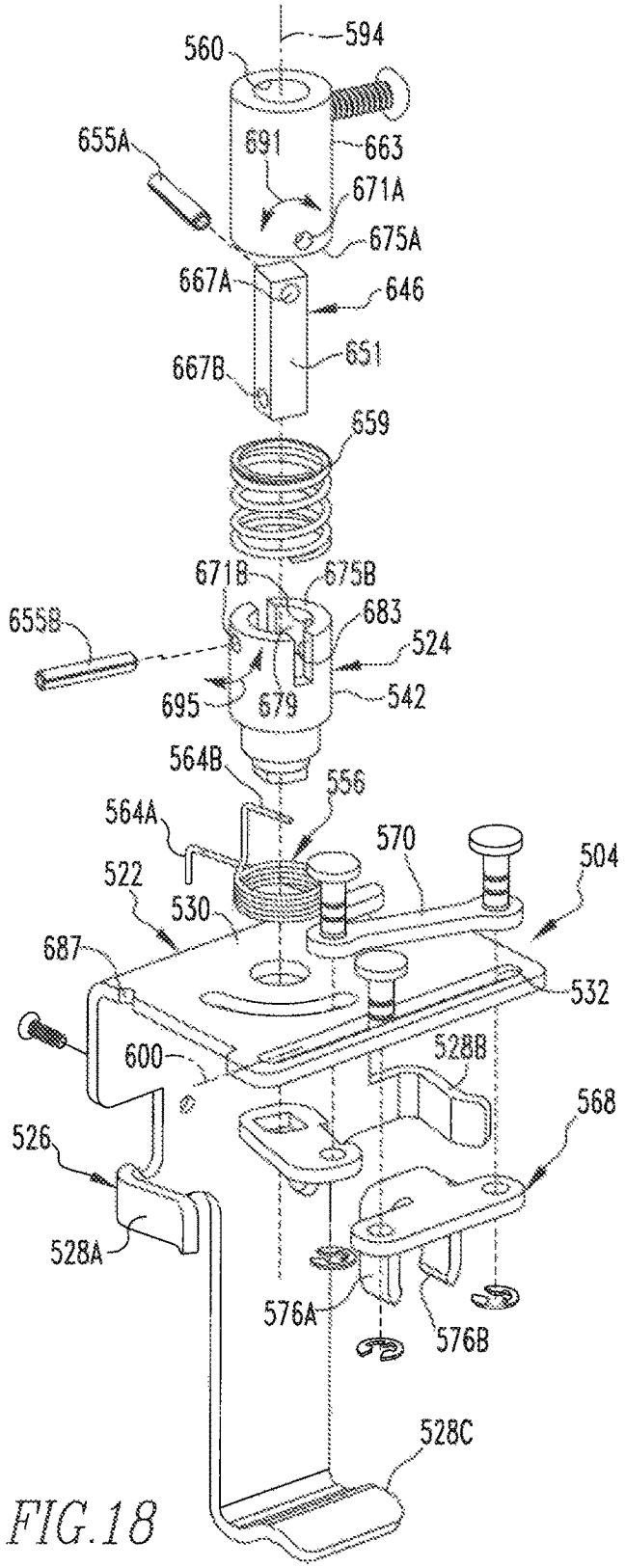
FIG. 18 is an exploded view of the apparatus of FIG. 16.

As can be understood from FIG. 18, the connection bar 651 has a pair of pivot bores 667A and 667B formed therein that extend in directions that are oriented orthogonal to one another. The mount 663 has a set of seats 671A formed therein, and the crank 542 likewise has a set of seats 671B formed therein. The roll pins 655A and 665B are rolled and formed to have a tiny longitudinal opening which permits the roll pins 655A and 655B to be elastically compressed such that they can be received in a press-fit fashion in the seats 671A and 671B, respectively, in the mount 663 and the crank 542, respectively, so that they are thereby fixedly connected with the mount 663 and the crank 542, respectively. It is noted, however, that the pivot bores 667A and 667B have a slightly larger diameter than the seats 671A and 671B such that the roll pins 655A and 655B are loosely fit in the pivot bores 667A and 667B to permit relative motion between the roll pins 655A and 655B and the connection bar 651 within the pivot bores 667A and 667B. This advantageously permits relative movement of the mount 663 with respect to the crank 542 in directions transverse to the axis of rotation 594. As such, the spring 659 is advantageously provided in a compressed condition interposed between the mount 663 and the crank 542 in order to bias the mount 663 toward a position aligned with the axis of rotation 594. The mount 663 has a confronting surface 675A formed thereon that faces generally toward the crank 542, and the crank 542 likewise has a confronting surface 675B formed thereon that faces generally toward the mount 663. The spring 659 engages the confronting surfaces 675A and 675B and is compressively received therebetween to result in biasing of the connection bar 651 and the mount 663 in a direction toward alignment with the axis of rotation 594. As such, while relative movement of the mount 663 and the connection bar 651 is permitted with respect to the crank 542 in directions transverse to the axis of rotation 594, the spring 659 being compressively received between the confronting surfaces 675A and 675B biases the connection bar 651 and the mount 663 toward an orientation aligned with the axis of rotation 594.

The crank 542 has a generally cylindrical socket 679 formed therein that receives the connection bar 651 when the roll pin 655B is received in the seats 671B and in the pivot bore 667B. The crank 542 further has a channel 683 formed therein that receives a leg 564B of a spring 556. An opposite leg 564A of the spring 556 is received in an indentation 687 that is formed in the platform 553.

Figure 19:
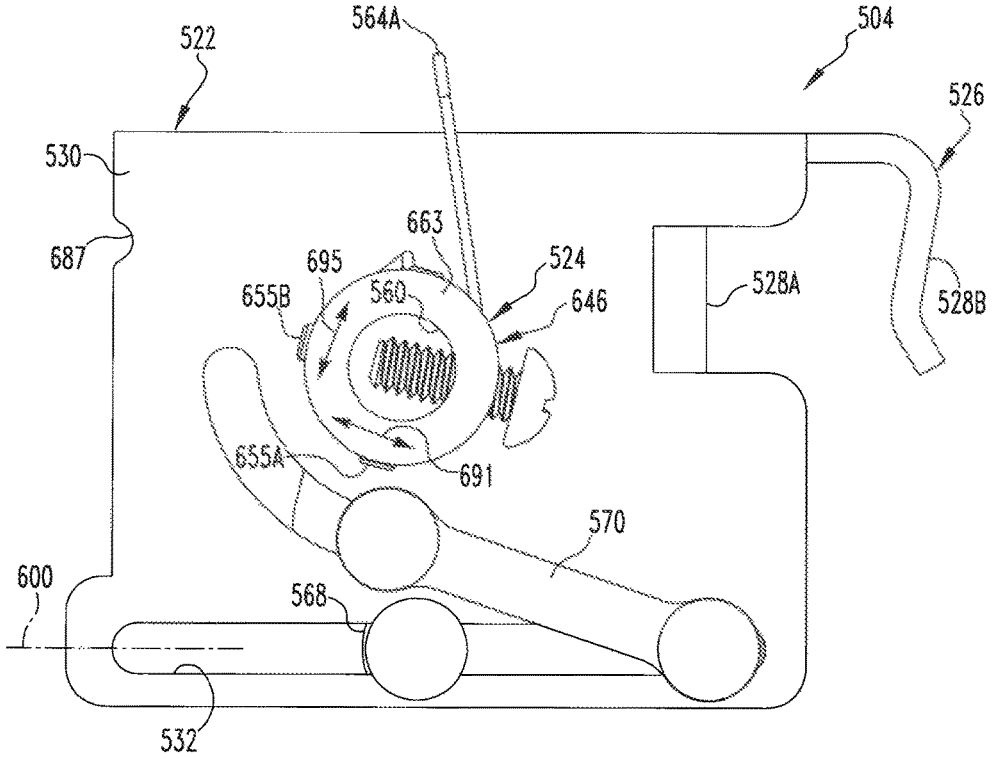
FIG. 19 is a top plan view of the apparatus of FIG. 16.

As can be understood from FIGS. 18 and 19, the clearance fit between the pivot bores 667A and 667B and the roll pins 655A and 655B, respectively, permits movement of the connection bar 651 and the mount 663 in directions transverse to the axis of rotation 594. More specifically, the roll pin 655A permits movement of the mount 663 in a first direction 691A with respect to the connection bar 651, which is pivoting movement in the first direction 691 about the roll pin 655A between the mount 663 and the connection bar 651 and thus with respect to the crank 542. Moreover, the clearance fit of the roll pin 655B in the pivot bore 667B permits pivoting movement of the connection bar 651 about the roll pin 655B in a second direction 695, which thus likewise permits rotational movement of the mount 663 in the second direction 695 about the roll pin 655B with respect to the crank 542. Movements in the first and second directions 691 and 695 are transverse to the axis of rotation 594. Since the pivot bores 667A and 667B are oriented orthogonal to one another, the rotational movements in the first and second directions 691 and 695, respectively, with respect to the crank 542 thus together enable pivoting movement of the mount 663 in all directions transverse to the axis of rotation 594.

The movement of the mount 663 in the first and second directions 691 and 695 with respect to the crank 542 is advantageous because the access port that is cut into the NEMA box 10 and through which the shaft 14 extends for connection with the mount 663 may not be perfectly aligned with the axis of rotation 594. For instance, such an access port might be drilled into the NEMA box 10 in the field, and perfect positioning of the access port with respect to the axis of rotation 594 can be difficult to achieve, which thus often results in a slight offset between the access port and the axis of rotation 594. By providing the universal joint 646, the mount 663 and thus the shaft 14 that will be mounted thereto is permitted to pivot away from the axis of rotation 594 with respect to the crank 542, which avoids binding of the shaft 14 with the wall of the NEMA box 10 within which the access port that has been formed.

In the depicted exemplary embodiment, the universal joint 646 permits the end of the shaft 14 to which the handle 12 is attached to move as much as 0.125 inches in all directions transverse to the axis of rotation 594. Such a dimension of allowed movement is selected to accommodate the most likely range of offset that is expected to occur in the field between the access port that is drilled into the NEMA box 10 and the axis of rotation 594, it being reiterated that the axis of rotation 594 passes through the crank 542. Inasmuch the axis of rotation 594 may be oriented in a horizontal direction, i.e., transverse to the direction of gravity, the bias of the spring 659 biases the mount 663 in a direction toward alignment with the axis of rotation 594, which avoids having the mount 663 droop downward with respect to the crank 542 as a result of gravity. The spring 659 thus facilitates reception of the shaft 14 in the receptacle 560 and thus facilitates assembly of the shaft 14 and handle 12 to the assembly 508. Other advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A rotary motion switching apparatus that is usable with a number of circuit interrupters, each circuit interrupter of the number of circuit interrupters having a housing and further having a switch situated on the housing, the rotary motion switching apparatus comprising:

a base;

an attachment system situated on the base, the attachment system comprising a number of connectors that are structured to engage a housing of a circuit interrupter of the number of circuit interrupters to affix the base to the housing;

a crank apparatus situated on the base, the crank apparatus comprising a first portion, a second portion, and a third portion;

the first portion being pivotable about an axis of rotation between a first orientation and a second orientation, the first portion and the second portion being engaged with one another at a location spaced from the axis of rotation, at least a part of the second portion being translatable along a movement axis between a first position and a second position, the first portion being in the first orientation when the at least part of the second portion is in the first position, the first portion being in the second orientation when the at least part of the second portion is in the second position;

the third portion being connected with the first portion and moving with the first portion between the first and second orientations, the third portion being movable with respect to the first portion in a direction transverse to the axis of rotation, the third portion being structured to be connected with a shaft that has a handle situated thereon; and the second portion having a number of lugs that are structured to engage a switch of a circuit interrupter of the number of circuit interrupters and to move the switch between a first state and a second state, the at least part of the second portion being structured to be in the first position when the switch is in the first state, the at least part of the second portion being structured to be in the second position when the switch is in the second state.

2. The rotary motion switching apparatus of claim 1 wherein the number of connectors comprise a first connector, a second connector, and a third connector that are structured to engage the housing to retain the housing between the first, second, and third connectors and to thereby affix the base to the housing.

3. The rotary motion switching apparatus of claim 2 wherein the first and second connectors are disposed in a confronting relationship with one another and are structured to retain a part of the housing between the first and second connectors.

4. The rotary motion switching apparatus of claim 3 wherein the third connector and at least one of the first connector and the second connector are structured to retain another part of the housing between the third connector and the at least one of the first connector and the second connector.

5. The rotary motion switching apparatus of claim 1 wherein the base comprises a plate-like support, and wherein the first, second, and third connectors each extend in a common direction away from the support.

6. The rotary motion switching apparatus of claim 5 wherein the base further comprises a platform that extends in the common direction away from the support, the crank apparatus being situated on the platform.

7. The rotary motion switching apparatus of claim 6 wherein the platform is situated at an end of the support, and wherein the third connector is situated at another end of the support opposite the platform.

8. The rotary motion switching apparatus of claim 6 wherein the first and second connectors are situated on the support generally between the end and the another end.

9. The rotary motion switching apparatus of claim 1 wherein the first portion and the second portion are pivotably connected together at the location spaced from the axis of rotation.

10. The rotary motion switching apparatus of claim 1 wherein the at least part of the second portion comprises a slider that is at least partially situated in a slot formed in the base.

11. The rotary motion switching apparatus of claim 10 wherein the second portion further comprises a link that is pivotably connected between the slider and the first portion.

12. The rotary motion switching apparatus of claim 1 wherein the first portion is situated on the base, and wherein the third portion is situated on the first portion.

13. The rotary motion switching apparatus of claim 12 wherein the third portion comprises a mount and connection bar, the connection bar being connected to the first portion and to the mount and being interposed between the first portion and the mount.

14. The rotary motion switching apparatus of claim 13 wherein the connection bar is movably connected to each of the first portion and the mount.

15. The rotary motion switching apparatus of claim 13 wherein the third portion further comprises a spring that is interposed between the first portion and the mount and that biases the mount in a direction toward alignment with the axis of rotation.

16. The rotary motion switching apparatus of claim 13 wherein the mount has a receptacle formed therein, the receptacle being structured to receive therein an end of the shaft.

17. An assembly comprising the rotary motion switching apparatus of claim 1, the assembly further comprising:

a number of circuit interrupters, each circuit interrupter of the number of circuit interrupters having a housing and further having a switch situated on the housing;

the number of connectors being engaged with a housing of a circuit interrupter of the number of circuit interrupters to affix the base to the housing; and the number of lugs being engaged with a switch of a circuit interrupter of the number of circuit interrupters to move the switch between the first state and the second state, the at least part of the second portion being in the first position when the switch is in the first state, the at least part of the second portion being in the second position when the switch is in the second state.

18. The assembly of claim 17 wherein the housing has a notch formed therein that is structured to receive a rail, a connector of the number of connectors being received in the notch.

19. The assembly of claim 17 wherein the number of connectors comprise a first connector, a second connector, and a third connector, and wherein the first and second connectors are disposed in a confronting relationship with one another and are biased toward one another and into engagement with the housing to retain a part of the housing between the first and second connectors.

20. The assembly of claim 19 wherein the third connector is biased toward at least one of the first connector and the second connector and into engagement with the housing to retain another part of the housing between the third connector and the at least one of the first connector and the second connector.

* * * * *